US009745690B2

(12) United States Patent
Lee et al.

(10) Patent No.: US 9,745,690 B2
(45) Date of Patent: Aug. 29, 2017

(54) EXHAUST TYPE CLOTHES DRYER AND METHOD FOR CONTROLLING AN EXHAUST TYPE CLOTHES DRYER

(71) Applicant: LG ELECTRONICS INC., Seoul (KR)

(72) Inventors: Sunki Lee, Seoul (KR); Daeyun Park, Seoul (KR); Byeongjo Ryoo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/945,832

(22) Filed: Nov. 19, 2015

(65) Prior Publication Data

US 2016/0160430 A1 Jun. 9, 2016

(30) Foreign Application Priority Data

Dec. 8, 2014 (KR) ..... 10-2014-0175165

(51) Int. Cl.
*D06F 58/28* (2006.01)
*D06F 58/20* (2006.01)
*D06F 58/02* (2006.01)

(52) U.S. Cl.
CPC ..... *D06F 58/28* (2013.01); *D06F 58/20* (2013.01); *D06F 58/02* (2013.01); *D06F 2058/2819* (2013.01); *D06F 2058/2838* (2013.01); *D06F 2058/2864* (2013.01)

(58) Field of Classification Search
CPC ..... F26B 21/00; F26B 21/06; D06F 58/02; D06F 58/20; D06F 58/28; D06F 2058/2819; D06F 2058/2838; D06F 2058/2864
USPC ..... 34/474, 601; 68/19, 20; 8/149, 159
See application file for complete search history.

(56) References Cited

U.S. PATENT DOCUMENTS 4,268,247 A * 5/1981 Freze ..... D06F 58/02 34/413
5,315,765 A * 5/1994 Holst ..... D06F 58/20 219/707
6,484,417 B2 * 11/2002 Tedman ..... F26B 21/06 34/131

(Continued)

FOREIGN PATENT DOCUMENTS

CN 1465764 1/2004
CN 1503864 6/2004

(Continued)

OTHER PUBLICATIONS

Korean Office Action dated Jul. 9, 2015 issued in Application No. 10-2014-0175165.

(Continued)

*Primary Examiner* — Stephen M Gravin
(74) *Attorney, Agent, or Firm* — KED & Associates, LLP

(57) ABSTRACT

A method for controlling an exhaust type clothes dryer may include measuring humidity of air passing through an interior of the drum to sense a degree of dryness of a target item, and discharging air that has passed through the drum or recirculating at least a portion of air that has passed through the drum to the drum by comparing a degree of dryness of the target item with a predetermined reference value. In the recirculating of air, an amount of recirculated air may be increased according to an increase in the degree of dryness of the target item by adjusting a degree of opening of a recirculation channel.

19 Claims, 8 Drawing Sheets

(56) References Cited

U.S. PATENT DOCUMENTS

| | | | | |
|---|---|---|---|---|
| 2005/0066538 | A1 | 3/2005 | Goldberg et al. | |
| 2008/0235977 | A1 | 10/2008 | Kuwabara | |
| 2009/0126220 | A1* | 5/2009 | Nawrot | D06F 58/28 34/497 |
| 2010/0024239 | A1 | 2/2010 | Kono et al. | |
| 2011/0030238 | A1* | 2/2011 | Nawrot | D06F 58/02 34/499 |
| 2012/0186305 | A1 | 7/2012 | Taniguchi et al. | |
| 2016/0160419 | A1* | 6/2016 | Ryoo | D06F 58/206 68/12.14 |
| 2016/0160430 | A1* | 6/2016 | Lee | D06F 58/20 34/474 |

FOREIGN PATENT DOCUMENTS

| | | | | |
|---|---|---|---|---|
| CN | 1886628 | | 12/2006 | |
| CN | 102433722 | | 5/2012 | |
| DE | 43 06 217 | | 9/1994 | |
| DE | 102 55 575 | | 12/2003 | |
| EP | 2 599 912 | | 6/2013 | |
| JP | 2005-024113 | | 1/2005 | |
| JP | 2006-149759 | | 6/2006 | |
| JP | 2006-296449 | | 11/2006 | |
| JP | 2007-222456 | | 9/2007 | |
| JP | 2007-301290 | | 11/2007 | |
| JP | 2008-142101 | | 6/2008 | |
| JP | 2008-220814 | | 9/2008 | |
| JP | 2010-06907 | | 4/2010 | |
| JP | 2013-081634 | | 5/2013 | |
| KR | 10-2005-0063968 | A | 6/2005 | |
| KR | 2006-0033188 | | 4/2006 | |
| KR | 10-0587358 | B1 | 6/2006 | |
| KR | 2006-0089073 | | 8/2006 | |
| KR | 10-0629343 | B1 | 9/2006 | |
| KR | 10-1312399 | B1 | 9/2013 | |
| KR | 10-1337699 | | 12/2013 | |
| KR | DE 202015106435 | U1 * | 2/2016 | D06F 58/20 |
| WO | WO 2014/095658 | | 6/2014 | |

OTHER PUBLICATIONS

Korean Office Action dated Jul. 9, 2015 issued in Application No. 10-2014-0175160.

European Search Report dated Apr. 20, 2016 issued in Application No. 15197566.1.

Australian Office Action dated Jun. 30, 2016 issued in Application No. 2015264797.

Chinese Office Action dated May 15, 2017 issued in Application No. 201510883500.9 (with English Translation).

Chinese Office Action dated May 22, 2017 issued in Application No. 201510895181.3 (with English Translation).

U.S. Appl. No. 14/959,883, filed Dec. 4, 2015.

* cited by examiner

EXHAUST TYPE CLOTHES DRYER AND METHOD FOR CONTROLLING AN EXHAUST TYPE CLOTHES DRYER

CROSS-REFERENCE TO RELATED APPLICATION

This application claims priority under 35 U.S.C. §119 to Korean Application No. 10-2014-0175165, filed on Dec. 8, 2014, whose entire disclosure is hereby incorporated herein by reference.

BACKGROUND OF THE DISCLOSURE

1. Field

A method for controlling an exhaust type clothes dryer are disclosed herein.

2. Background

In general, a clothes dryer is a device for drying laundry by blowing heated air generated by a heater into a drum to evaporate moisture contained in the laundry. Clothes dryers may be classified as an exhaust type clothes dryer or a condensing type clothes dryer depending on whether humid air has passed through the drum after drying laundry.

FIG. 1 is a schematic view illustrating a related art exhaust type clothes dryer. Referring to FIG. 1, the exhaust type clothes dryer may include a drum 1 into which a target item may be introduced, an intake channel 2 that connects to a side of the drum 1 so that ambient air may be introduced into the drum, a heater 4 provided at or in the intake channel 2 to heat air introduced into the drum 1, an exhaust channel 3 that connects to another side of the drum 1 so that air that has passed through the drum 1 may be discharged outside of the clothes dryer, and a blower 5 provided so that ambient air may be introduced through the intake channel 2, thus providing power to the ambient air in the exhaust channel so that the ambient air may be introduced through the intake channel 2 and discharged through the exhaust channel 3.

As the drum 1 rotates, a target item, for example, an item of clothing, introduced into the drum 1 may move inside the drum 1. As the blower 5 operates, ambient air outside of a case of the exhaust type clothes dryer may be introduced into the intake channel 2 and heated by the heater 4. The heated air may be supplied to an interior of the drum for a predetermined period of time to dry the target item, and humid air evaporated from the target item may be discharged through the exhaust channel 3.

However, changes in a degree of dryness of the target item and a temperature and relative humidity of air discharged from the drum 1 may occur as drying is in progress. That is, at a latter point in the drying when drying of the laundry approaches completion, the temperature of the discharged air may be high and the relative humidity, or ratio of steam included in the air, of the discharged air may be low. Therefore, rather than being used to remove moisture from the target item, a ratio of heated air lost may increase and considerably reduce energy efficiency during drying.

BRIEF DESCRIPTION OF THE DRAWINGS

The embodiments will be described in detail with reference to the following drawings in which like reference numerals refer to like elements wherein.

DETAILED DESCRIPTION

Description will now be given in detail of embodiments, with reference to the accompanying drawings. For the sake of brief description with reference to the drawings, the same or like components will be provided with the same or like reference numbers, and description thereof will not be repeated. As used herein, the singular forms "a", "an" and "the" are intended to include the plural forms as well, unless the context clearly indicates otherwise.

A method for controlling a clothes dryer according to embodiments may be applied to an exhaust type clothes dryer in which ambient air introduced from outside of a case may be heated by a heater, the heated air may be supplied to a drum to dry a target item, and air that has passed through the drum may be discharged outside of the case through an exhaust channel or duct. Energy efficiency may be enhanced by increasing in stages amounts of recirculated air when a degree of dryness of a target item increases.

Figure 2:
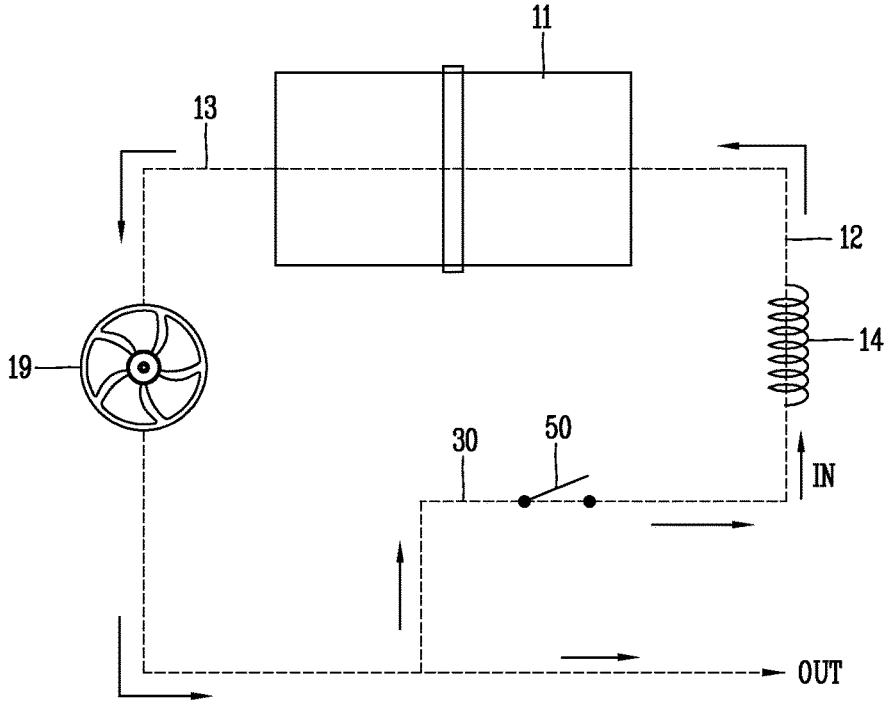
FIG. 2 is a schematic view of an exhaust type clothes dryer according to an embodiment.
Figure 3:
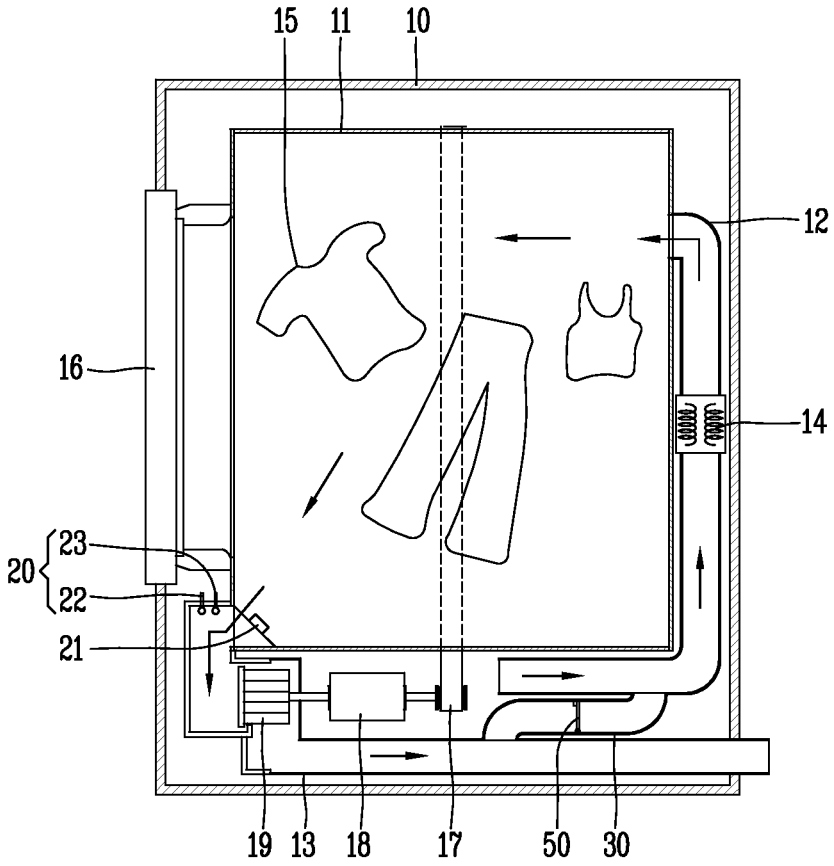
FIG. 3 is a schematic cross-sectional view of an exhaust type clothes dryer according to an embodiment.
Figure 4:
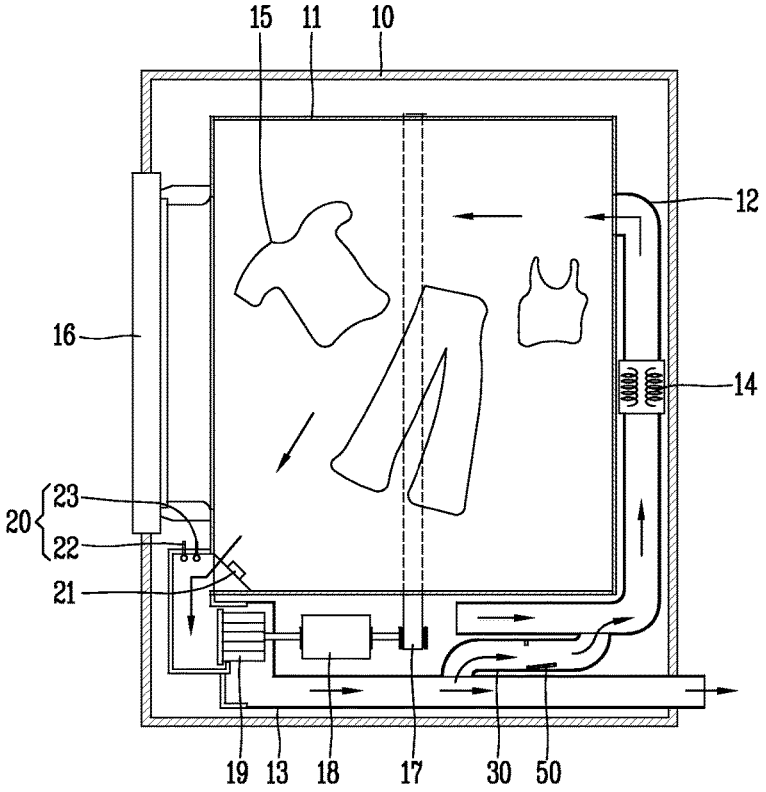
FIG. 4 is another schematic cross-sectional view of an exhaust type clothes dryer according to an embodiment illustrating recirculation of a portion of air from an exhaust duct along a recirculation channel.

FIG. 2 is a schematic view illustrating an exhaust type clothes dryer according to an embodiment. FIG. 3 is a schematic cross-sectional view of an exhaust type clothes dryer according to an embodiment. FIG. 4 is a schematic cross-sectional view illustrating recirculation of a portion of air from an exhaust duct along a recirculation channel.

The exhaust type clothes dryer may include a drum 11 into which a target item 15, for example, clothes, may be introduced, an intake channel or duct 12 that provides a flow channel to supply air to the drum 11, an exhaust channel or duct 13 that provides a flow channel to discharge air that has passed through the drum 11 outside of a case 10, and a heater 14 that heats air from the intake duct 12. The case 10 may form an outer appearance of the clothes dryer. An opening may be formed on or at a side of the case 10 to allow the target item 15 to be introduced therethrough. A door 16 may be provided at a side of the case 10. The door 16 may have a hinge structure and may open and close the opening.

The drum 11 may have a cylindrical shape. The drum 11 may be provided to be rotatable inside of the case 10. A belt 17 may be wound around an outer surface of the drum 11, and the drum 11 may receive power through the belt 17 from outside. Power transmitted from the outside may be generated by a drive motor 18. The drive motor 18 may be provided between a lower portion of the drum 11 and a lower surface of the case 10. The drive motor 18 may be connected to the belt 17, and as the drive motor 18 runs, rotational force from the drive motor 18 may be transmitted to the outer surface of the drum 11 through the belt 17 to rotate the drum 11.

A plurality of lifters may be spaced apart on an inner surface of the drum 11 in a circumferential direction. When the drum 11 rotates, the introduced target item 15 may be rotated and lifted by the plurality of lifters, and when the target item 15 reaches a top of the drum 11, the target item may be dropped within the drum 11. This operation, called "tumbling", may be performed repeatedly. Accordingly, when heated air is supplied to an interior of the drum 11, evaporation of moisture from the target item 15 may increase. The intake duct 12 may form a flow channel through which ambient air may be introduced to the interior of the drum 11. An upper end portion of the intake duct 12 may be connected to a rear side of the drum 11, and a lower end portion of the intake duct 12 may extend from a lower rear side of the drum 11 to the outside of the case 10.

The exhaust duct 13 may form a flow channel through which air that has passed through the drum 11 may be discharged to the outside of the case 10. An end portion or a front end portion of the exhaust duct 13 may be connected to a lower end portion of the front side of the drum 11, for example, an outlet of the drum 11 with reference to air flow direction, and another end portion or a rear end portion of the exhaust duct 13 may be connected to the outside of the case 10.

A blower 19 may be provided in the intake duct 12 and/or the exhaust duct 13. The blower 19 illustrated in FIG. 3 may be provided in the exhaust duct 13. When the blower 19 is in use, ambient air may be introduced into the intake duct 12, and the ambient air may be supplied to the drum 11 along the intake duct 12. The blower 19 may be driven by power from the drive motor 18.

The heater 14 may be provided in the intake duct 12. Air passing through the intake duct 12 may be heated by the heater 14, and the heated air may be supplied to the interior of the drum 11. An electric heating wire may be provided within the heater 14. When power is applied to the electric heating wire, heat may be generated by the electric heating wire, and air passing through the heater 14 may be heated by the heat from the electric heating wire. Thus, heated air supplied to the interior of the drum 11 may evaporate moisture out of and dry the target item 15. Air may be heated by the heater 14, and drying may occur for a predetermined period of time.

Figure 5:
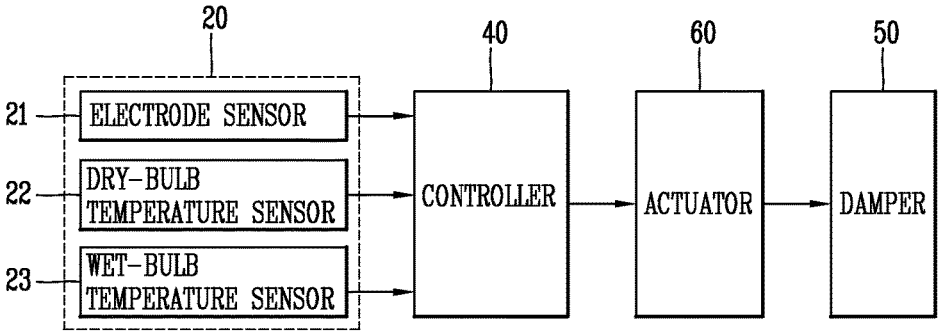
FIG. 5 is a block diagram of an exhaust recirculation device of the exhaust type clothes dryer according to an embodiment.

FIG. 5 is a block diagram of an exhaust recirculation device of the exhaust type clothes dryer according to an embodiment. The exhaust type clothes dryer according to an embodiment may include a humidity sensing unit or sensor 20, a recirculation channel 30, a damper 50, and a controller 40 in order to recover heat lost when the target item 15 is dried.

The humidity sensor 20 may be an electrode sensor 21 provided at an outlet of the drum 11. The electrode sensor 21 may measure a voltage value that changes according to an amount of moisture of the target item 15 introduced to the interior of the drum 11 to sense a degree of dryness of the target item 15. When heated air is blown into the interior of the drum 11, the heated air may contact the target item 15 in a wet state within the drum 11 and may evaporate moisture from the target item 15.

The evaporated moisture and air may be introduced to the exhaust duct 13 at the outlet of the drum 11, and the electrode sensor 21 may measure an amount of vapor included in the air that passes through the outlet of the drum 11. The electrode sensor 21 may be configured such that, as vapor contained in the air contacts the electrode sensor 21, a voltage value may increase as an amount of vapor is increased. The voltage value, measured according to the amount of vapor included in the air, may be transmitted to the controller 40. The controller 40 may receive the measured voltage value from the electrode sensor 21 and may calculate a mass of vapor distributed per unit of dry air, that is, an absolute humidity value, upon receiving the measured voltage value from the electrode sensor 21.

The humidity sensor 20 may include a dry-bulb temperature sensor 22 and a wet-bulb temperature sensor 23. The dry-bulb temperature sensor 22 and the wet-bulb temperature sensor 23 may be provided at the outlet of the drum 11 or may be provided at an inlet of the exhaust duct 13. The dry-bulb temperature sensor 22 and the wet-bulb temperature sensor 23 illustrated in FIG. 3 may be provided at the inlet of the exhaust duct 13. The dry-bulb temperature sensor 22 may be a thermometer, and the wet-bulb temperature sensor 23 may be a thermometer in which a temperature measurement portion may be covered by, for example, cloth.

When air released from the outlet of the drum 11 passes through the dry-bulb temperature sensor 22 and the web-bulb temperature sensor 23, the cloth covering the temperature measurement portion of the wet-bulb temperature sensor 23 may become wet from vapor in the air of the outlet of the drum 11. As moisture of the wet cloth may absorb ambient heat, an ambient temperature may be lowered to lower a temperature value of the wet-bulb temperature sensor 23. Air may evaporate more readily as it becomes drier, and a temperature valve of the web-bulb temperature sensor 23 may be further lowered.

A dry-bulb temperature value of the dry-bulb temperature sensor 22 and a wet-bulb temperature value of the wet-bulb temperature sensor 23 measured or detected according to an amount of vapor in the air may be transmitted to the controller 40. The controller 40 may receive the measured dry-bulb temperature value and the measured wet-bulb temperature value from the dry-bulb temperature sensor 22 and the wet-bulb temperature sensor 23, respectively, and may calculate a ratio of vapor in the air, that is, a relative humidity value.

The controller 40 may be, for example, a microcomputer. The controller 40 may include a memory that stores a plurality of reference voltage values and a reference relative humidity value. The memory may store a voltage value from the electrode sensor 21 and the dry-bulb temperature value and the wet-bulb temperature value received, respectively, from the dry-bulb temperature sensor and the wet-bulb temperature sensor 23.

The recirculation channel 30 may connect the exhaust duct 13 and the intake duct 12 to provide a flow channel that recirculates air from the exhaust duct 13 to the intake duct 12. A first end of the recirculation channel 30 may be connected to the exhaust duct 13, and a second end of the recirculation channel 30 may be connected to the intake duct 12. All or a portion of air from the exhaust duct 13 may be introduced into the recirculation channel 30 and may be transmitted to the interior of the drum 11. The second end of the recirculation channel 30 may be connected to an inlet of the heater 14 or may be connected to at least a portion of the intake duct 12. The second end of the recirculation channel 30 may also be directly connected to the drum 11. The second end of the recirculation channel 30 illustrated in FIG. 3 may be connected to the intake duct 12 and the inlet of the heater 14.

The controller 40 may increase an amount of recirculated air when a degree of dryness of the target item 15 increases by adjusting in stages a degree of opening of the recirculation channel 30. The degree of opening of the recirculation channel 30 may be adjusted by a damper 50.

The damper 50 may be rotatably provided in the recirculation channel 30 to open and close the recirculation channel 30. A first side or end of the damper 50 may be coupled to the recirculation channel 30 via a hinge such that a second side or end of the damper 50 may be rotated to open and close the recirculation channel 30. As an angle of opening of the damper 50 increases, a degree of opening of the recirculation channel 30 may be increased.

Figure 6:
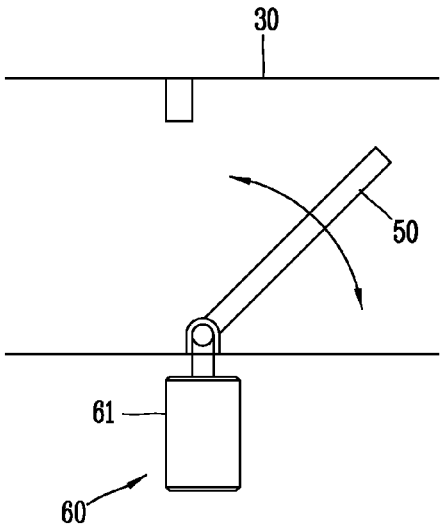
FIG. 6 is a schematic view of a damper drive according to an embodiment.
Figure 7:
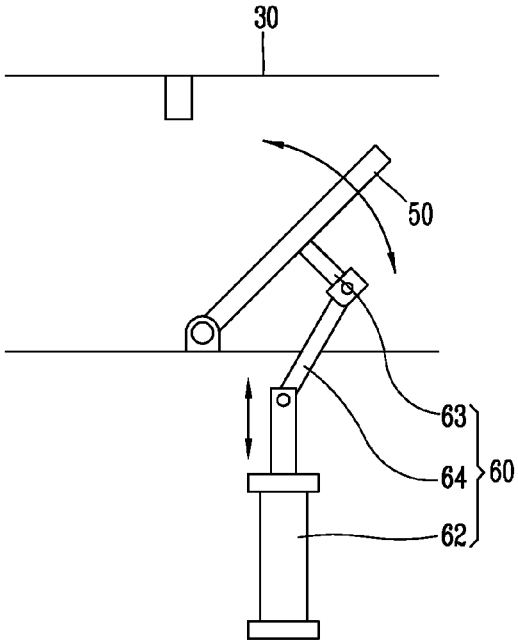
FIG. 7 is a schematic view of a damper drive according to another embodiment.

FIG. 6 is a schematic view of a damper drive according to an embodiment. FIG. 7 is a schematic view of a damper drive according to another embodiment.

The damper 50 may be driven by an actuator 60. The actuator 60 may include a motor 61 or a cylinder mechanism 62. The damper 50 may be directly connected to an output shaft of the motor 61 or may be connected to the output shaft of the motor 61 via, for example, a gear. The damper 50 illustrated in FIG. 6 may be directly connected to the output shaft of the motor 61. When the motor 61 is running, a rotational force from the motor 61 may be transmitted to a hinge of the damper 50 to rotate the damper 50 and adjust a degree of opening of the damper 50. The actuator 60, the motor 61, and the cylinder mechanism 62 may be controlled upon receiving a control signal from the controller 40.

The damper 50 illustrated in FIG. 7 may be driven by a pneumatic or hydraulic cylinder mechanism 62. The damper 50 may be connected to the cylinder mechanism 62 through a first link 63 and a second link 64 to received drive power.

The first link 63 may protrude from a rear surface of the damper 50, an end of the second link 64 may be hinge-coupled to a first end of the first link 63, and a second end of the second link 64 may be hinge-coupled to the cylinder mechanism 62. When the cylinder mechanism 62 operates, a piston of the cylinder mechanism 62 may move forward and backward and the drive power may be transmitted to the first link member 63 and the second link member 64, thereby adjusting the degree of opening of the damper 50.

A flow rate adjustment valve may be separately provided in the exhaust duct 13 to adjust an amount of air discharged through the exhaust duct 13. The flow rate adjustment valve may be provided at a lower point at which the recirculation channel 30 may be branched from the exhaust duct 13.

Figure 8:
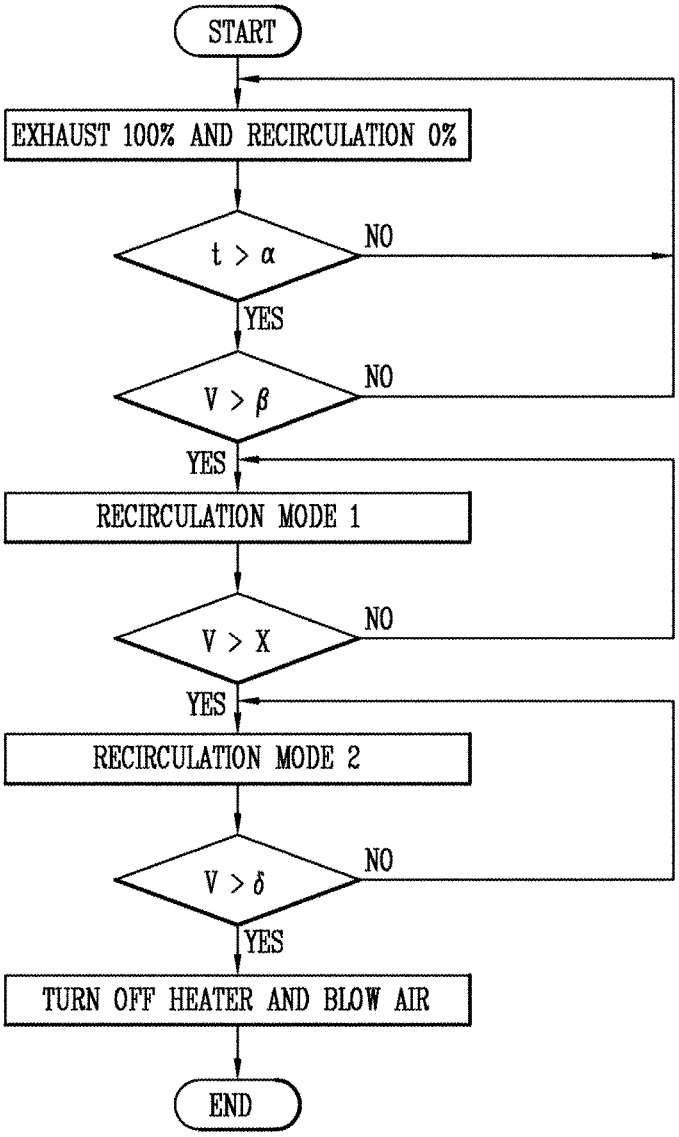
FIG. 8 is a flow chart of a method for controlling an exhaust type clothes dryer according to an embodiment.
Figure 9:
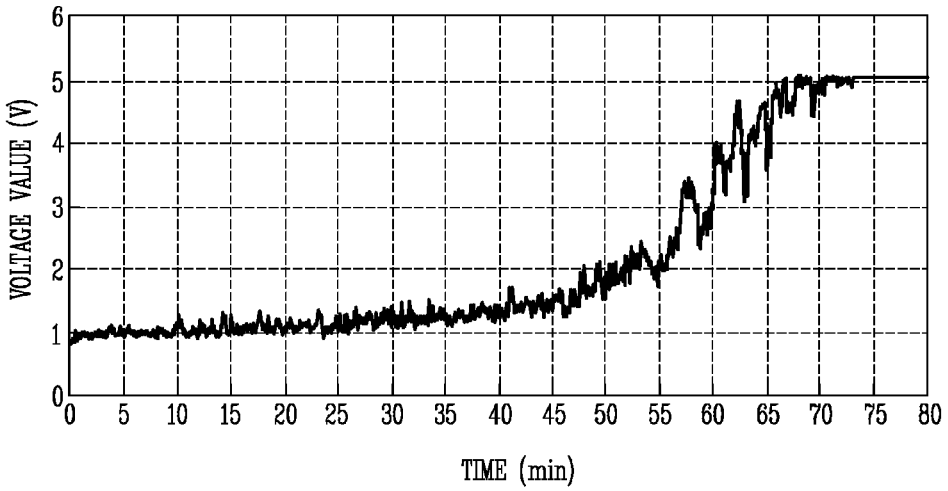
FIG. 9 is a graph illustrating a change in a voltage signal of an electrode sensor over time when drying is performed.
Figure 10:
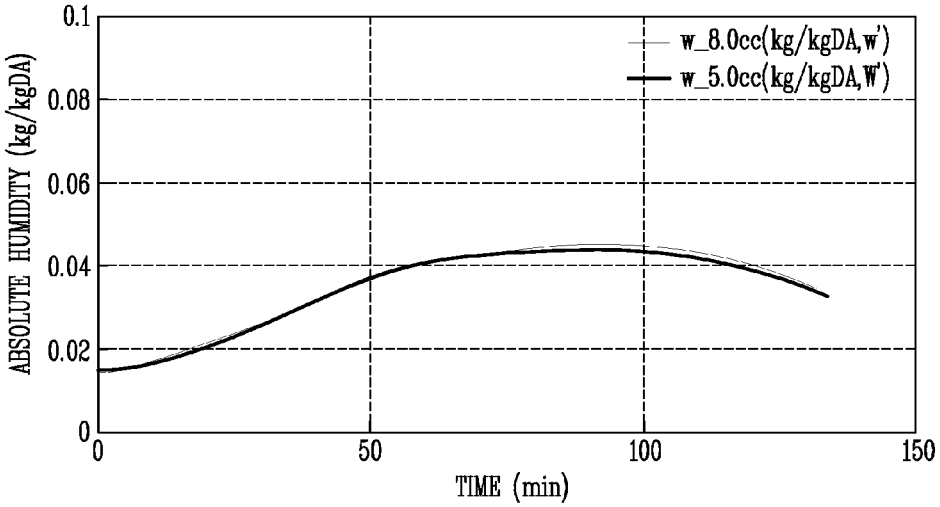
FIG. 10 is a graph illustrating a change in absolute humidity over time at an outlet of a drum.

FIG. 8 is a flow chart of a method for controlling an exhaust type clothes dryer according to an embodiment. FIG. 9 is a graph illustrating a change in voltage signal of an electrode sensor over time when drying is performed. FIG. 10 is a graph illustrating a change in absolute humidity over time at an outlet of a drum.

At an initial stage of operating the clothes dryer, air within the clothes dryer may be introduced to the heater 14 through the intake duct 12 and heated by the heater 14, and air having a high temperature may be introduced to the interior of the drum 11 to dry the target item 15, such as wet clothes. Air that has passed through the drum 11 may not be recirculated and all of the air may be discharged through the exhaust duct 13.

After a predetermined period of time (t) has passed ($t>\alpha$), a degree of dryness of the target item 15 may be sensed by the electrode sensor 21, whose voltage value may be changed according to an amount of moisture in the target item 15.

That is, towards a last period of drying, or at a later point in the drying, the target item 15 may be almost dried. FIG. 9 illustrates that, in general, a voltage value may rapidly increase when drying is almost completed. The rapid change in the voltage value may represent a reduction in a mass of vapor distributed per unit of dry air, that is, a reduction in absolute moisture. This may mean that a considerable portion of the heated air was discharged, rather than used for drying the target item 15.

In the embodiment, the controller 40 may compare the voltage value detected by the electrode sensor 21 with a predetermined reference voltage value. When the detected voltage value is greater than the reference voltage value, the controller 40 may determine that a considerable portion of air that has passed through the drum 11 is dry, enable dry air discharged through the exhaust duct 13 to be introduced to the recirculation flow path 30, heat the dry air by the heater 14, and recirculate the heated air to the interior of the drum 11.

As a considerable portion of the heated air is not used for drying the target item 15, but rather, is discharged, the heated air may be reused. Additionally, an amount of heated air from the heater 14 may be reduced, and an energy saving effect may be obtained.

In one embodiment, a method for controlling an exhaust type clothes dryer may be subdivided such that a plurality of recirculation modes are predetermined or set, and an amount of recirculated air may be gradually increased while drying is in progress by adjusting, in stages, a degree of opening of the recirculation channel 30 using the damper 50. For example, when drying is in progress in the clothes dryer, the electrode sensor 21 provided at the outlet of the drum 11 may detect a voltage value changed according to an amount of moisture in the air that has passed through the drum 11.

The controller 40 may receive the detected voltage value from the electrode sensor 21 and measure an absolute humidity in order to sense a degree of dryness of the target item 15. The controller 40 may compare the measured voltage value from the electrode sensor 21 with a predetermined reference voltage value according to the recirculation mode.

For example, when the voltage value V of the electrode sensor 21 is greater than a first reference voltage value ($\beta$), the controller 40 may transmit a control signal to the actuator 60 according to recirculation mode 1. According to the control signal, a drive force may be generated in the actuator 60, and an angle of opening of the damper 50 may be adjusted by the drive force of the actuator 60. Thus, a degree of opening of the recirculation channel 30 may be adjusted according to the angle of opening of the damper 50. If the voltage value of the electrode sensor 21 is smaller than or equal to the first reference voltage value, an exhaust mode may be performed without recirculation.

Thereafter, when the voltage value of the electrode sensor 21 is greater than a second reference voltage value (x), the controller 40 may transmit a control signal to the actuator 60 according to recirculation mode 2. An angle of opening of the damper 50 may be adjusted by the drive force generated by the actuator 60 according to the control signal. Thus, a degree of opening of the recirculation channel 30 may be adjusted according to the angle of opening of the damper 50. When the voltage value of the electrode sensor 21 is smaller than or equal to the second reference voltage value, the degree of opening of the recirculation channel 30 may be adjusted according to recirculation mode 1. The second reference voltage value may be a value greater than the first reference voltage value.

Additionally, when the voltage value of the electrode sensor 21 is greater than a third reference voltage value (δ), the controller 40 may turn off the heater 14 and operate only the blower 19 to blow air introduced into the intake duct 12 to the interior of the drum 11.

Because a degree of dryness of the target item 15 within the drum 11 may be sensed by using the voltage value of the electrode sensor 21 and exhausted heated air may be recirculated when the degree of dryness is equal to or greater than a predetermined value, an amount of heating of the heater 14 may be reduced to save energy.

Figure 11:
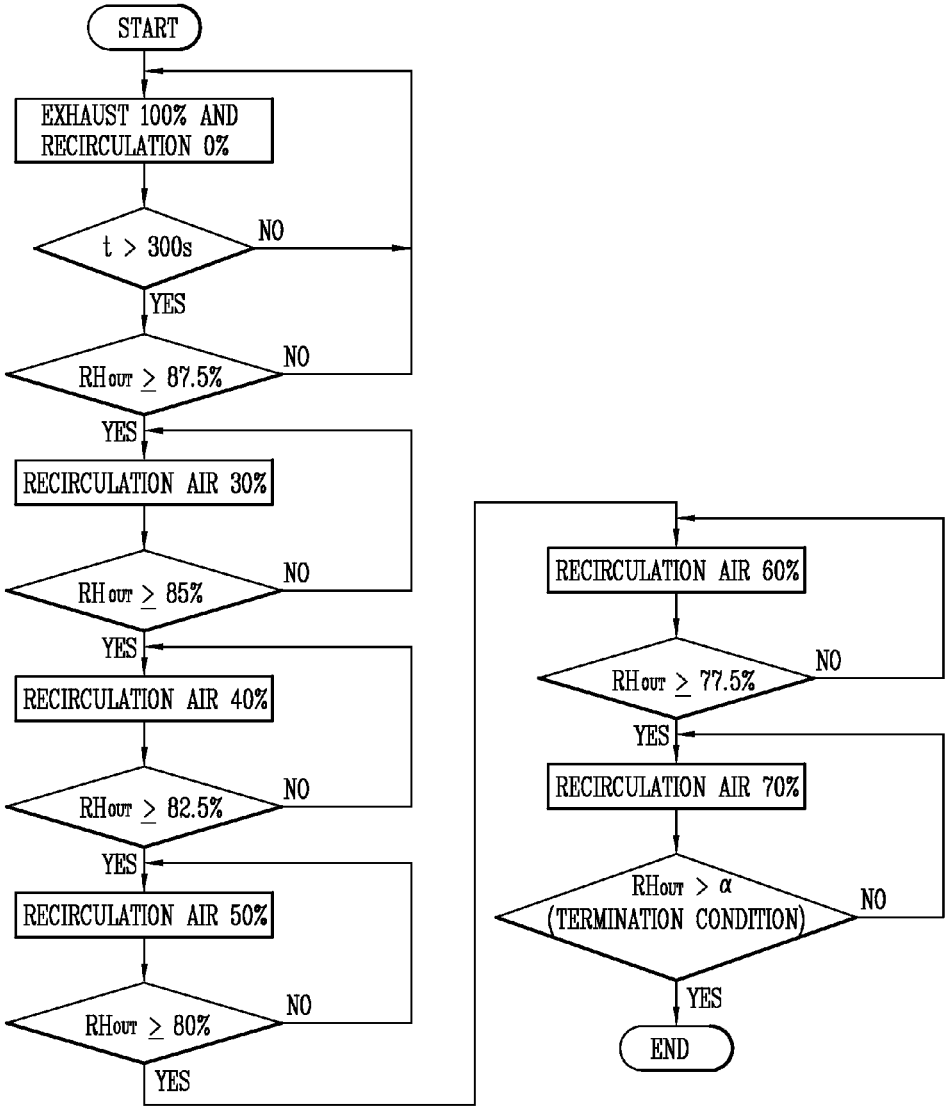
FIG. 11 is a flow chart of a method for controlling an exhaust type clothes dryer according to another embodiment.
Figure 12:
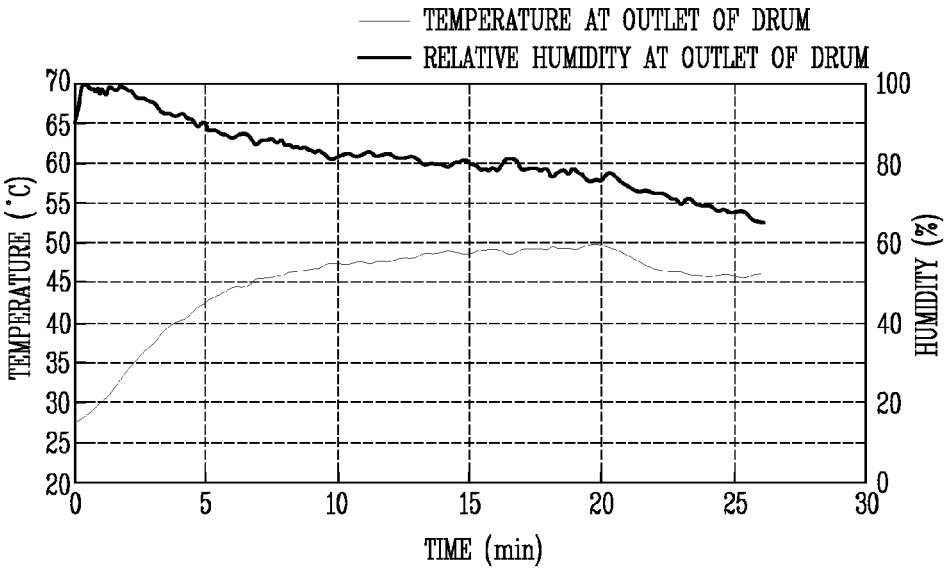
FIG. 12 is a view illustrating temperature and relative humidity at an outlet of the drum in an exhaust type clothes dryer.

FIG. 11 is a flow chart of a method for controlling an exhaust type clothes dryer according to another embodiment. FIG. 12 is a view illustrating temperature and relative humidity at an outlet of a drum in an exhaust type clothes dryer.

In FIG. 11, a relative humidity may be calculated using a dry-bulb temperature and a wet-bulb temperature measured by the dry-bulb temperature sensor 22 and the wet-bulb temperature sensor 23, respectively, and an amount of recirculated air may be controlled based on an amount of relative humidity. Referring to FIG. 12, as drying is in progress, the relative humidity at the outlet of the drum 11 may be reduced.

Thus, as a drying time elapses, air having low humidity may be discharged from the outlet of the drum 11 and the air having a low humidity and discharged from the outlet of the drum 11 may be recirculated to increase energy efficiency during drying. The relative humidity at the outlet of the drum 11 may be calculated, for example, as a moving average value for one minute, and whenever the value decreases to less than a predetermined value, a ratio of recirculated air may be increased by adjusting, for example, the damper 50 of the recirculation channel 30. Thus, as drying may be performed by increasing a flow amount of recirculated air as drying is in progress, energy efficiency and other advantages may increase.

According to another embodiment, the method for controlling the exhaust type clothes dryer using relative humidity may be further subdivided such that a plurality of recirculation modes may be predetermined or set and an amount of recirculated air may be increased according to drying situation by adjusting, in stages, a degree of opening of the recirculation channel 30. For example, when drying is performed in the clothes dryer, the dry-bulb temperature sensor 22 and the wet-bulb temperature sensor 23 provided at the inlet of the exhaust duct 13 may detect, respectively, a dry-bulb temperature value and a wet-bulb temperature value of air that has passed through the drum 11.

The controller 40 may receive the detected dry-bulb temperature value and the wet-bulb temperature value from the dry-bulb temperature sensor 22 and the wet-bulb temperature sensor 23 and sense a degree of dryness of the target item 15. The controller 40 may compare the measured relative humidity value from the dry-bulb temperature sensor 22 and the wet-bulb temperature sensor 23 with a predetermined reference relative humidity value according to the plurality of recirculation modes.

For example, when the measured relative reference humidity value ($RH_{OUT}$) is smaller than a first reference relative humidity value, for example, 87.5%, the controller 40 may transmit a control signal to the actuator 60 according to a recirculation mode 1. According to the control signal, a drive force may be generated in the actuator 60 and an angle of opening of the damper 50 may be adjusted by the drive force of the actuator 60. As the degree of opening of the recirculation channel 300 may be adjusted according to the angle of opening of the damper 60, an amount of recirculation air may be adjusted to 30%, for example. If the measured relative humidity value is greater than or equal to the first reference relative humidity value, an exhaust mode may be performed without recirculation.

Thereafter, when the measured relative humidity value $RH_{OUT}$ is smaller than a second reference relative humidity value, for example, 85%, a degree of opening of the recirculation channel 30 may be adjusted according to a recirculation mode 2, thereby adjusting an amount of recirculation air to 40%, for example. When the measured relative humidity value $RH_{OUT}$ is greater than or equal to the second reference voltage value, an amount of recirculation air may be adjusted to 30%, for example, according to recirculation mode 1.

Next, when the measured relative humidity value $RH_{OUT}$ is smaller than a third reference relative humidity value, for example, 82.5%, a degree of opening of the recirculation channel 30 may be adjusted according to a recirculation mode 3, thereby adjusting an amount of recirculation air to 50%, for example. When the measured relative humidity value $RH_{OUT}$ is greater than or equal to the third reference voltage value, an amount of recirculation air may be adjusted to 40%, for example, according to recirculation mode 2.

Next, when the measured relative humidity value $RH_{OUT}$ is smaller than a fourth reference relative humidity value, for example, 80.5%, a degree of opening of the recirculation channel 30 may be adjusted according to recirculation mode 4, thereby adjusting an amount of recirculation air to 60%, for example. When the measured relative humidity value $RH_{OUT}$ is greater than or equal to the fourth reference voltage value, the amount of recirculation air may be adjusted to 50%, for example, according to recirculation mode 3.

Thereafter, when the measured relative humidity value $RH_{OUT}$ is smaller than a fifth reference relative humidity value, for example, 77.5%, a degree of opening of the recirculation channel 30 may be adjusted according to recirculation mode 5, thereby adjusting an amount of recirculation air to 70%, for example. When the measured relative humidity value $RH_{OUT}$ is greater than or equal to the fifth reference voltage value, the amount of recirculation air may be adjusted to 60%, for example, according to recirculation mode 4.

Finally, when the measured relative humidity value $RH_{OUT}$ is greater than a sixth reference relative humidity value (α), the controller 40 may turn off the heater 14 and turn on only the blower 19 to blow air introduced into the intake duct 12 to the interior of the drum 11 or may terminate operation of the clothes dryer.

Experimental Example

Figure 1:
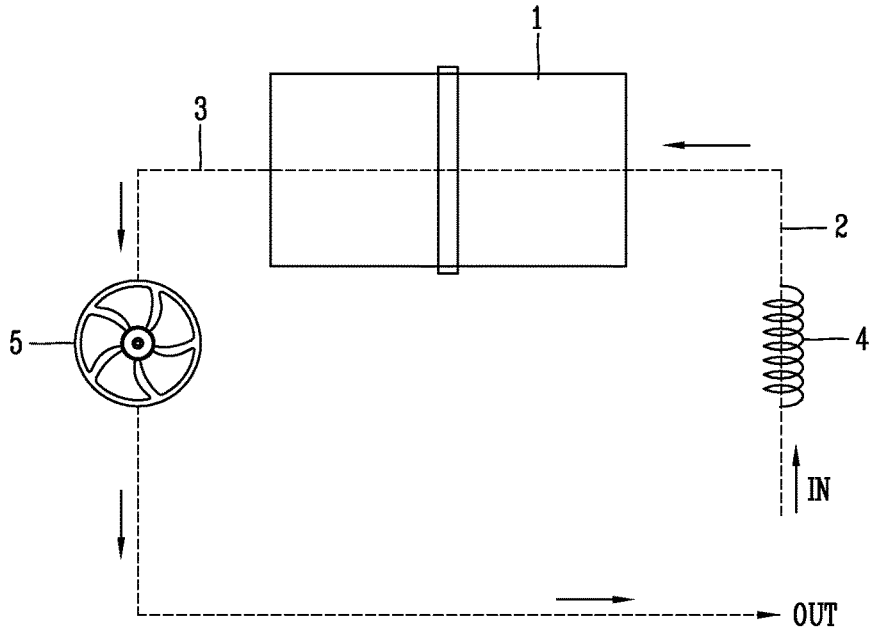
FIG. 1 RELATED ART
FIG. 1 is a schematic view of a related art exhaust type clothes dryer.

Comparative Example 1 to Comparative Example 4 correspond to experiments measuring temperature, relative humidity, absolute humidity, and an amount of evaporation at each position of a related art exhaust type clothes dryer illustrated in FIG. 1. In comparative Example 1, a relative humidity value RH1 (relative humidity) of air introduced to the inlet of the heater 14 is 0.5, a temperature T1 of air at the inlet of the heater 14 is 23.0° C., and absolute humidity ω2 of air at the inlet of the drum 11 heated by the heater 14 is 0.0087. In the comparative Example 1 to comparative Example 4, T2 is a temperature of air at the inlet of the drum 11 heated by the heater 14, T3 is a temperature of air at the outlet of the drum 11, and ω3 is an absolute humidity of air at the outlet of the drum 11.

Embodiment 1 to Embodiment 4 correspond to experiments of measuring temperature, relative humidity (%), absolute humidity, and an amount of evaporation at each position of an exhaust type clothes dryer according to embodiments illustrated in FIGS. 2 and 4. In the exhaust type clothes dryer according to Embodiment 1 to Embodiment 4, T1 is a temperature of air at the inlet of the heater 14, T2 is a temperature of air at the inlet of the drum 11 heated by the heater 14, and T4 is a temperature of air at a point where the recirculation channel 30 and the intake channel meet. RH1 is a relative humidity value of air introduced to the inlet of the heater 14, ω2 is an absolute humidity of air at the inlet of the drum 11 heated by the heater 14, ω3 is an absolute humidity of air at the outlet of the drum 11, and ω4 is an absolute humidity of air at a point at which the recirculation channel 30 joins the intake flow channel.

The results of experiments of the comparative examples and the embodiments are as follows.

TABLE 1

| | Relative humidity at outlet of drum | Amount of recirculated air | Temperature (° C.) T1 | T2 | T3 | T4 | Absolute humidity (ω) Inlet of drum (ω) | Outlet of drum (ω) | Amount of evaporation (ω3-ω2) | Change in amount of evaporation |
|---|---|---|---|---|---|---|---|---|---|---|
| Comparative example 1 | 90 | None | 23.0 | 130.6 | 41.7 | | 0.0087 | 0.0446 | 0.0359 | |
| Embodiment 1 | 90 | 30 | 23.0 | 137.9 | 47.4 | 30.3 | 0.0241 | 0.0599 | 0.0358 | 0.2% reduced |
| Comparative example 2 | 87.5 | None | 23.0 | 141.0 | 43.6 | | 0.0087 | 0.0479 | 0.0392 | |
| Embodiment 2 | 87.5 | 30 | 23.0 | 148.9 | 49.5 | 30.9 | 0.0255 | 0.0649 | 0.0394 | 0.4% increased |
| Comparative example 2 | 85 | None | 23.0 | 154.7 | 45.9 | | 0.0087 | 0.0524 | 0.0437 | |
| Embodiment 2 | 85 | 40 | 23.0 | 167.5 | 55.0 | 35.8 | 0.0380 | 0.0821 | 0.0441 | 1.2% increased |
| Comparative example 3 | 82.5 | None | 23.0 | 167.3 | 48.5 | | 0.0087 | 0.0476 | 0.0389 | |
| Embodiment 3 | 82.5 | 50 | 23.0 | 178.8 | 59.9 | 41.5 | 0.0546 | 0.1006 | 0.0460 | 1.4% increased |
| Comparative example 3 | 80 | None | 23.0 | 167.3 | 48.5 | | 0.0087 | 0.0476 | 0.0389 | |
| Embodiment 3 | 80 | 60 | 23.0 | 193.2 | 66.2 | 48.9 | 0.0484 | 0.1297 | 0.0813 | 1.7% increased |
| Comparative example 4 | 77.5 | None | 23.0 | 172.8 | 49.7 | | 0.0087 | 0.0492 | 0.0405 | |
| Embodiment 4 | 77.5 | 70 | 23.0 | 208.5 | 58.7 | 58.7 | 0.1259 | 0.1761 | 0.0502 | 2.2% increased |

As illustrated in Table 1, a change in an amount of evaporation according to a ratio of recirculated air was calculated at an interval of 2.5%, starting from when a relative humidity value at the outlet of the drum was 90%, and loss of heat according to a change in temperature of the clothes dryer was calculated with respect to a temperature of the outlet of the drum 11.

Theoretically, high efficiency may be obtained as the proportion of recirculation is maintained to be high from the early stage of drying based on insulation conditions in the clothes dryer. However, as heat loss increases according to an increase in temperature of the clothes dryer due to recirculation, it may be more effective to adjust an amount of recirculation air to an appropriate ratio according to a change in the relative humidity.

Referring to Table 1, the amount of evaporation was rather reduced when an amount of recirculation air was set to 30% when relative humidity at the outlet of the drum 11 was 90%. Then, the amount of evaporation was gradually increased by increasing the ratio of recirculated air according to the reduction in the relative humidity at the outlet of the drum, and an optimal and energy efficient result was obtained. Further, a method for controlling an exhaust type clothes dryer capable of enhancing energy efficiency by re-using heat lost at a latter part of drying in the clothes dryer is provided according to embodiment disclosed herein.

Further, a method for controlling an exhaust type clothes dryer capable of enhancing energy efficiency as drying is in progress by gradually increasing an amount of recirculated air by adjusting a degree of opening a flow channel for recirculation of air in stages according to an increase in a degree of drying of a target item is also provided according to embodiments disclosed herein.

Embodiments disclosed herein provide a method for controlling an exhaust type clothes dryer in which ambient air introduced from the outside of a case is heated by a heater, the heated air is supplied to a drum to dry a target item, and air that has passed through the drum is discharged to the outside of the case through an exhaust duct. The method may include measuring, by a humidity sensing unit or sensor, a humidity of air passing through the interior of the drum to sense a degree of dryness of the target item; and exhausting, by a control unit or controller, air that has passed through the drum or recirculating at least a portion of air which has passed through the drum, to the drum, by comparing the degree of dryness of the target item with a predetermined reference value. In the recirculating of air, an amount of recirculated air may be increased according to a rise in a degree of dryness of the target item by adjusting a degree of opening of a recirculation channel.

The humidity sensor may be an electrode sensor provided at an outlet of the drum and configured to sense a degree of dryness of the target item according to a voltage value changed according to an amount of moisture of the target item introduced to the interior of the drum. The humidity sensor may be provided at the outlet of the drum and include a dry-bulb temperature sensor and a wet-bulb temperature sensor configured to measure a dry-bulb temperature and a wet-bulb temperature at the outlet of the drum. The degree of opening of the recirculation channel may be adjusted by a damper rotatably provided at the recirculation channel and an actuator configured to rotate the damper to be opened and closed.

The recirculating may include a plurality of preset recirculation modes such that amounts of recirculated air are different. The control unit may compare reference voltage values previously set or predetermined according to the plurality of recirculation modes and a measurement value from the electrode sensor, and adjust a degree of opening of the recirculation channel according to a preset or predetermined amount of recirculation air in a corresponding mode among the plurality of recirculation modes. The recirculating may include a plurality of preset or predetermined recirculation modes such that amounts of recirculated air may be different. The control unit may calculate a relative humidity using measurement values measured by each of the dry-bulb temperature sensor and the wet-bulb temperature sensor, compare the reference relative humidity values previously set according to the plurality of recirculation modes and the calculated relative humidity calculated using the measurement value, and adjust a degree of opening of the recirculation channel according to an amount of recirculation air previously set or predetermined in the corresponding mode among the plurality of recirculation modes. The recirculating may include turning off the heater.

Energy efficiency may be increased by reusing air discharged from the drum as drying of a target item is in progress in the exhaust type clothes dryer. Also, by increasing a ratio of recirculated air according to a reduction in a relative humidity at the outlet of the drum, an optimal result may be obtained and energy efficiency may be further enhanced.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling an exhaust type clothes dryer in which ambient air introduced from an outside of a case is heated by a heater, the heated air is supplied to a drum to dry a target item, and air that has passed through the drum is discharged to the outside of the case through an exhaust duct, the method comprising:

measuring, by a humidity sensor, relative humidity of air passing through an interior of the drum to sense a degree of dryness of the target item; and discharging, by a controller, air that has passed through the drum, or recirculating at least a portion of air that has passed through the drum back to the drum by comparing the degree of dryness of the target item with a predetermined reference value, wherein, in the recirculating of air, when the relative humidity at an outlet of the drum is higher than 87.5%, air is discharged from the drum without recirculating any of the air back to the drum, and when the relative humidity is equal to or lower than 87.5%, the portion of air recirculated to the drum increases as the relative humidity decreases, wherein the portion of air is increased in stages.

2. The method of claim 1, wherein the recirculating of at least the portion of air includes turning off the heater.

3. The method of claim 1, wherein the degree of opening of the recirculation channel is adjusted by a damper rotatably provided at the recirculation channel and an actuator configured to rotate the damper to be opened and closed.

4. The method of claim 1, wherein the humidity sensor includes an electrode sensor provided at an outlet of the drum and configured to sense a degree of dryness of the target item according to a voltage value changed according to an amount of moisture of the target item introduced to the interior of the drum.

5. The method of claim 4, wherein the recirculating of at least the portion of air includes a plurality of predetermined recirculation modes such that amounts of recirculated air are different.

6. The method of claim 5, wherein the controller compares predetermined reference voltage values according to the plurality of recirculation modes and a measurement value from the electrode sensor and adjusts the degree of opening of the recirculation channel according to a predetermined amount of recirculation air in a corresponding mode among the plurality of recirculation modes.

7. The method of claim 1, wherein the humidity sensor is provided at an outlet of the drum and includes:

a dry-bulb temperature sensor configured to measure a dry-bulb temperature, and a wet-bulb temperature sensor configured to measure a wet-bulb temperature.

8. The method of claim 7, wherein the recirculating of at least the portion of air includes a plurality of predetermined recirculation modes such that amounts of recirculated air are different.

9. The method of claim 8, wherein the controller calculates a relative humidity using measurement values measured by each of the dry-bulb temperature sensor and the wet-bulb temperature sensor, compares predetermined reference relative humidity values according to the plurality of recirculation modes and the relative humidity calculated using the measurement values, and adjusts the degree of opening of the recirculation channel according to a predetermined amount of recirculation air in a corresponding mode among the plurality of recirculation modes.

10. An exhaust type clothes dryer operated using the method of claim 1.

11. An exhaust type clothes dryer, comprising:

a case;

a drum rotatably provided in the case;

an intake duct that introduces ambient air from outside of the case into the case and supplies heated air to the drum to dry a target item;

a heater that heats air in the intake duct;

a humidity sensor that measures a humidity of air passing through an interior of the drum to sense a degree of dryness of the target item;

an exhaust channel that discharges air that has passed through the drum to the outside of the case;

a blower provided inside of the exhaust channel;

a recirculation channel that recirculates air from the exhaust channel back to the drum; and a controller that compares the degree of dryness of the target item with a predetermined reference value to control an amount of air that the exhaust channel discharges and an amount of recirculated air that the recirculation channel recirculates, wherein during the recirculating of air, when the relative humidity at an outlet of the drum is higher than 87.5%, the air passing through the drum is not recirculated into the drum but discharged to the outside of the case; and when the relative humidity is equal to or lower than 87.5%, the amount of the air recirculated into the drum is gradually increased in stages as the relative humidity decreases.

12. The dryer of claim 11, wherein the humidity sensor includes an electrode sensor provided at an outlet of the drum and configured to sense the degree of dryness of the target item according to a voltage value changed according to an amount of moisture of the target item introduced to the interior of the drum.

13. The dryer of claim 12, wherein the humidity sensor is provided at an outlet of the drum and includes a dry-bulb temperature sensor and a wet-bulb temperature sensor configured to measure a dry-bulb temperature and a wet-bulb temperature, respectively, at the outlet of the drum.

14. The dryer of claim 13, wherein the controller includes a plurality of predetermined recirculation modes to control the amount of recirculated air recirculated in the recirculation channel and discharged in the exhaust channel.

15. The dryer of claim 14, wherein the controller is configured to calculate a relative humidity using measurement values measured by each of the dry-bulb temperature sensor and the wet-bulb temperature sensor, compare predetermined reference relative humidity values according to the plurality of recirculation modes and the relative humidity calculated using the measurement values, and adjust the degree of opening of the recirculation channel according to a predetermined amount of recirculation air in the corresponding mode among the plurality of recirculation modes.

16. The dryer of claim 11, wherein the controller includes a plurality of predetermined recirculation modes to control the amount of recirculated air recirculated in the recirculation channel and discharged in the exhaust channel.

17. The dryer of claim 16, wherein the controller is configured to compare predetermined reference voltage values according to the plurality of recirculation modes and a measurement value from the electrode sensor and adjust the degree of opening of the recirculation channel according to a predetermined amount of recirculation air in a corresponding mode among the plurality of recirculation modes.

18. The dryer of claim 11, further including a damper rotatably provided in the recirculation channel that adjusts the degree of opening of the recirculation channel, and an actuator that rotates the damper to be opened and closed.

19. The dryer of claim 11, wherein the controller includes a mode to turn off the heater.

* * * * *